United States Patent [19]

Oger

[11] 4,037,417

[45] July 26, 1977

[54] VOUSSOIR FOR A CASING

[75] Inventor: Jacques Oger, Pont-a-Mousson, France

[73] Assignee: Pont-A-Mousson S.A., Nancy, France

[21] Appl. No.: 560,013

[22] Filed: Mar. 19, 1975

[30] Foreign Application Priority Data

Mar. 22, 1974 France ..... 74.10002

[51] Int. Cl.[2] ..... E21D 11/22

[52] U.S. Cl. ..... 61/45 R; 52/86; 52/88

[58] Field of Search ..... 61/45, 41, 84, 85; 52/86, 88, 593, 594

[56] References Cited

U.S. PATENT DOCUMENTS

| | | | |
|---|---|---|---|
| 422,901 | 3/1890 | Arnett | 52/594 |
| 984,337 | 2/1911 | Woodworth | 61/45 R |
| 1,043,348 | 11/1912 | O'Rourke | 61/45 R |
| 2,077,137 | 4/1937 | Wilkoff | 61/45 R |
| 2,816,329 | 12/1957 | Sogaro | 52/86 |
| 3,483,704 | 12/1969 | Tabor | 61/45 R |

*Primary Examiner*—Jacob Shapiro

*Attorney, Agent, or Firm*—Sughrue, Rothwell, Mion, Zinn and Macpeak

[57] ABSTRACT

Casing voussoir of the type comprising a web in the general shape of a sector of a cylindrical ring and at least two juxtaposition walls substantially perpendicular to said web and parallel to each other, wherein the voussoir has guide means for the juxtaposition of said walls between two neighboring voussoirs of the casing, said guide means being constituted by at least two elements of conjugate shape, one being a hollow in one of the walls and the other being a projection on the other wall, said elements having a clearance therebetween when the two voussoirs are juxtaposed along said walls.

8 Claims, 2 Drawing Figures

Figure 1:
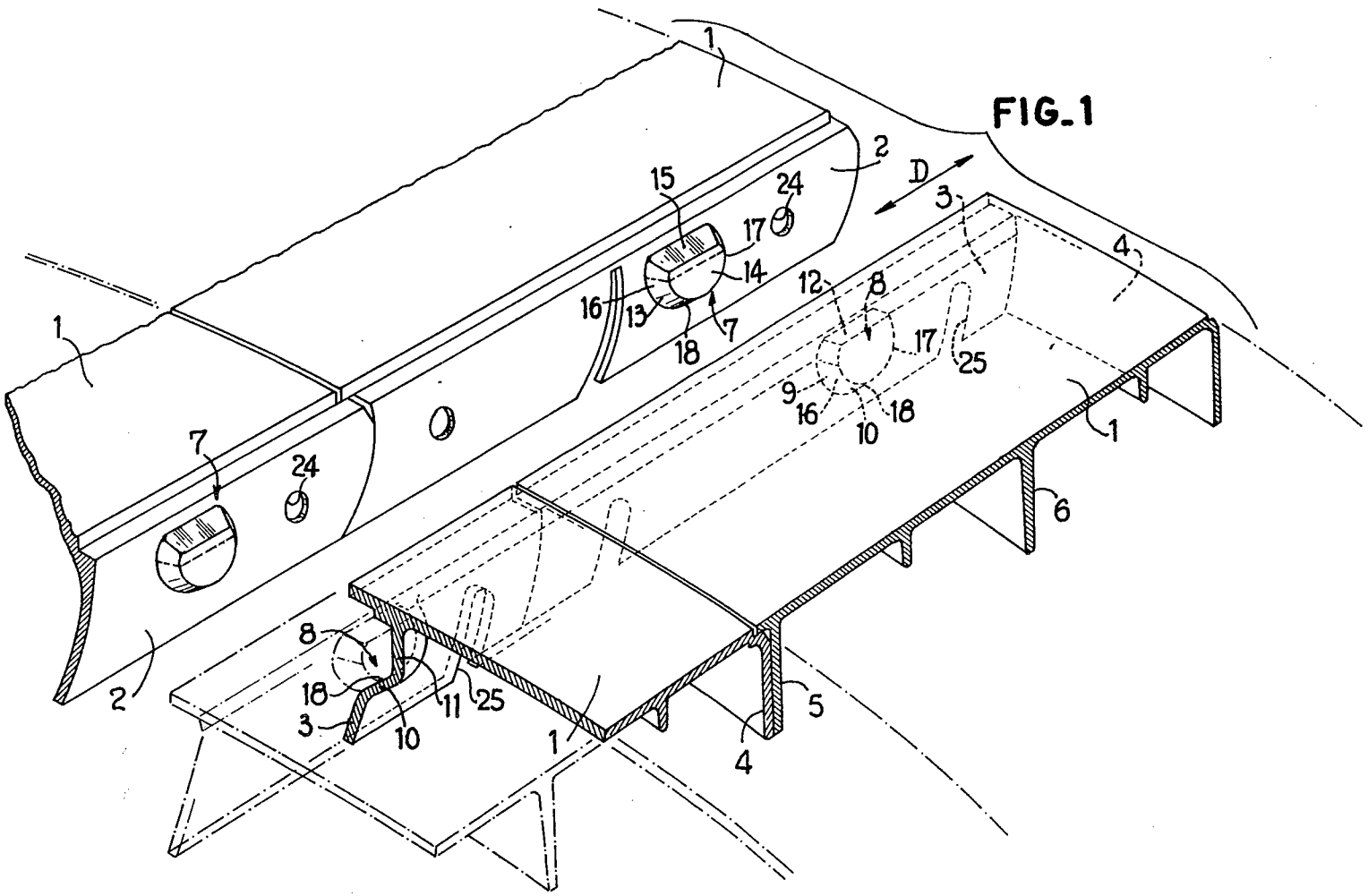

D
1
2
3
4
5
6
7
8
9
10
11
12
13
14
15
16
17
18
24
25

VOUSSOIR FOR A CASING

The present invention relates to voussoirs for casings of the type which comprise a web in the general shape of a cylindrical ring sector and at least two juxtaposing walls roughly perpendicular to said web and parallel to each other.

These voussoirs are in particular employed in the construction of casings or linings of for example cast iron for lining tunnels, wells and like underground works. The web of these voussoirs then has the general shape of a portion of a cylinder whose profile is either corrugated in the axial direction of the cylinder or continuous and it is surrounded by a rectangular frame of walls. In this case, these voussoirs as assembled in both circumferential direction and axial direction so as to constitute a cylindrical casing.

An object of the present invention is to achieve the best possible centering between juxtaposed voussoirs.

According to the invention, there is provided a voussoir of the aforementioned type, wherein the voussoir has guide means for the juxtaposition of said walls between two neighbouring voussoirs of the casing, said guide means being constituted by at least two elements of conjugate shape, one being a hollow in one of the walls and the other being a projection on the other wall, said elements having a clearance therebetween when the two voussoirs are juxtaposed along said walls.

There may be provided a single projecting element on one of the walls and a single hollow element on the other, the elements then having, for each one of the considered directions, abutment surfaces in both directions. By way of a modification, according to one of the considered directions, the projecting element and the hollow element may have abutment surfaces in a single direction, a projecting element and a hollow element then being both provided on each wall.

In a first particular embodiment of the invention, the projecting element is constituted by a boss and the associated hollow element by a dish portion. In another particular embodiment, the projecting element is constituted by a roughly rectangular-sided tab and the hollow element comprises an opening of associated shape.

The hollow element may comprise an opening formed in the wall and surrounded by a portion which is integral with this wall around the opening and projects inwardly of the voussoir. By way of a modification, the hollow element may comprise an opening formed in the wall and communicating directly with the interior of the voussoir.

These various possibilities may be arranged in any possible combination. However, a voussoir having a boss and dish portion is preferably constructed with abutment surfaces provided in both directions and with an integral portion for the hollow element which projects inside the voussoir, whereas on the other hand a voussoir having a tab and associated opening is constructed preferably with abutment surfaces in a single direction and an opening for the hollow element communicating directly with the interior of the voussoir. The first construction is also employed preferably in the case of a continuous web, whereas the second is preferably employed in the case of a web having a corrugated profile.

The centering is achieved just as advantageously between the different voussoirs of the same casing ring as between the different rings themselves and also just as well between any voussoirs on the site as between certain voussoirs that may be pre-assembled in a fixture in the factory.

Figure 2:
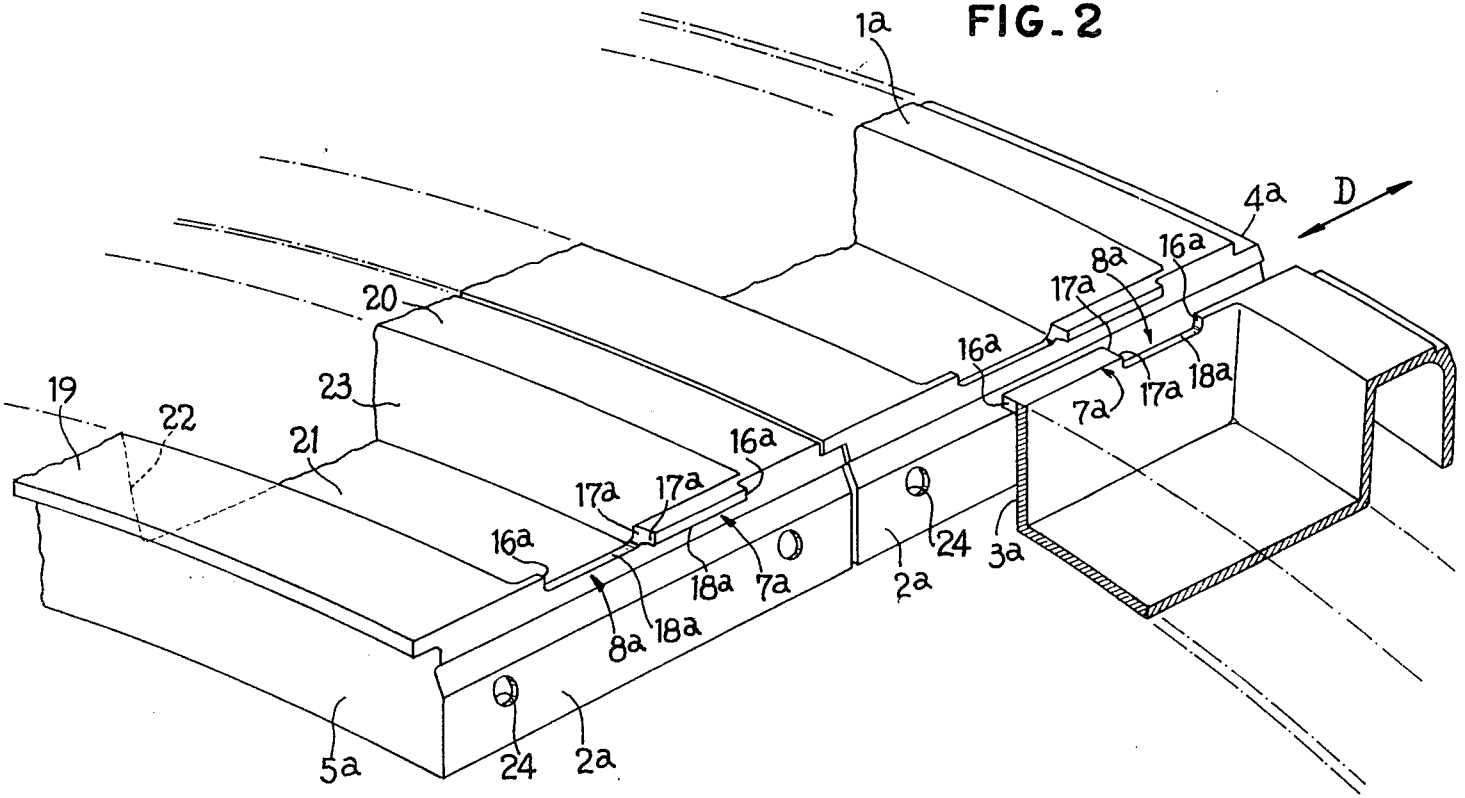

Further features and advantages of the invention will be apparent from the ensuing description with reference to the accompanying drawings given solely by way of example and in which:

FIG. 1 is a perspective view of four voussoirs in a first embodiment of the invention which have bosses and dish portions and juxtaposed along the axial direction of the casing to be produced but slightly separated in the circumferential direction, and FIG. 2 is a view similar to FIG. 1 but with only three voussoirs in accordance with a second embodiment of the invention having tabs and openings.

The voussoirs shown in FIG. 1 comprise a web 1 in the form of a portion of a continuous cylinder and surrounded by a rectangular frame constituted by four juxtaposition walls which are roughly perpendicular to said web and extend in a direction toward the axis of the cylinder. Two of these walls 2 and 3 are oriented in a direction D parallel to the axis of the cylinder and the other two walls 4 and 5 are oriented perpendicular to this direction, that is to say circumferentially with respect to the axis of the cylinder. The axial walls 2 and 3 have in the radial direction a slighly curved profile which is concave on one and convex on the other, which facilitate placing the voussoirs in position with respect to each other in the circumferential direction. Moreover, the web 1 of the voussoirs have inner reinforcing ribs 6.

In the centre region in the axial direction, and also roughly in the middle in the radial direction, the axial wall 2 has a projecting element 7 and the second wall 3 has a hollow element 8. The projecting element 7 is constituted by a boss which is part of the material of the wall 2 and the associated hollow element 8 is constituted by a dish portion which is part of the material of the wall 3 and disposed exactly in facing relation to the boss 7.

The hollow element or dish portion 8 comprises an opening 9 formed in the wall 2 and surrounded by a portion 10 which projects inside the voussoir. This inner projecting portion of the dish portion has the general shape of a truncated cone having an axis perpendicular to the wall 3 and a rather small apex angle and a base 11 roughly parallel to the wall 3. The lateral face 10 of the dish portion is interrupted in a part of its periphery by a portion having a planar surface 12 which is parallel to the direction D and is slightly inclined with respect to the web 1 and diverges from this web in the direction of the end 11.

The projecting element or boss 7 has exactly the same shape as the hollow element or dish portion 8 with a frustoconical lateral surface 13, an end wall 14 and a portion having a planar surface 15 with however dimensions which are slightly less so that the boss 7 of one voussoir can engage in the dish portion 8 of the adjacent voussoir in the circumferential direction. This clearance is necessary in order to avoid hindering the assembly, it being increased by manufacturing tolerances.

Thus the frustoconical surfaces 10 and 13 of the dish portion and boss each have abutment surfaces 16 and 17 in both directions of the direction D and an abutment surface 18 in a radial direction, whereas the portions having a planar surface 12 and 15 constitute the abutment surfaces in the second radial direction.

The frustoconical shape of the boss and dish portion facilitates the bringing of the latter in the facing relation with the boss and, as soon as the boss enters the dish portion, a perfect centering is achieved of the two voussoirs with respect to each other in both the axial and radial directions.

The voussoirs are advantageously composed of cast iron and the bosses and dish portions are moulded by means of cores (FIG. 1 showing moreover traces of the joint plane of the bosses 7), these bosses and dish portions having wall thicknesses in respect of the parts defining the faces 14 and end wall roughly equal to that of the walls of the frame.

Although FIG. 1 does not show it, the circumferential walls 4 and 5 may also have bosses and associated dish portions which permit an assembly and a centering of these walls in both the circumferential and radial directions.

The voussoirs shown in FIG. 2 also have a web $1^a$ which has the general shape of a portion of a cylinder and is surrounded by a rectangular frame constituted by four walls $2^a$, $3^a$, $4^a$ and $5^a$, but the web $1^a$ is corrugated in the axial direction, namely in the direction D. This corrugation has a rectangular shape and comprises two corrugation crest surfaces 19 and 20 disposed along a cylindrical surface which is the outermost surface of the voussoirs and which are connected to the circumferential walls $4^a$ and $5^a$ and a corrugation root surface 21 disposed along a cylindrical surface which is the innermost of the voussoir, this surface 21 being connected to the exterior surfaces 19 and 20 by two slightly inclined radial surfaces 22 and 23. The axial dimension of the surface 21 corresponds approximately to one half of the axial overall dimension of the voussoir.

Each one of the axial walls $2^a$ and $3^a$ of a voussoir has in the region of the outer corrugation surfaces 19 and 20 of the web and in adjacent relation in the direction D between the roughly radial walls 22 and 23, a hollow element $8^a$ and a projecting element $7^a$. The hollow element $8^a$ is constituted by an opening having a roughly rectangular-sided shape whose dimension in the direction D roughly corresponds to one half of that of the corrugation surface 21, whereas its dimension in the radial direction rougly corresponds to the thickness of the wall $2^a$. This opening opens onto said outermost surface containing corrugation surfaces 19 and 20 of the web so that it is only defined by a surface $18^a$ extending in the direction D and two surfaces $16^a$ and $17^a$ perpendicular to this direction without any surface confronting the surface $18^a$. This opening moreover opens directly onto the inside of the voussoir in the corrugation roots defined by the surfaces 21, 22 and 23.

The projection element $7^a$ is constituted by a tab which has a roughly rectangular-sided shape and is part of the same material as the wall $2^a$ so as to constitute on the latter a flange which is oriented circumferentially outwardly. The dimensions of this flange correspond to those of the opening $8^a$ but are slightly less with a clearance allowing the assembly of a tab in an opening, these dimensions increased by manufacturing tolerances. The circumferential dimension of the sole projecting part of the tab or flange roughly corresponds to the thickness of the wall $2^a$ or of the opening $8^a$. Further, this tab or flange tapers toward its free end owing to the inclination of its lowermost axial wall which extends in the same direction as the web away from the wall $2^a$. This lower surface constitutes an abutment surface $18^a$ whereas the axial ends of the tab constitute two other abutment surfaces $16^a$ and $17^a$.

The wall $3^a$ also has an opening $8^a$ and a tab $7^a$ but disposed in the opposite direction with respect to each other in the direction D. Thus, as shown in FIG. 2, when the wall $3^a$ of a neighbouring voussoir is brought into facing relation with the wall $2^a$, the tab $7^a$ of this neighbouring voussoir is located in front of the opening $8^a$ of the first voussoir whereas the opening $8^a$ of the neighbouring voussoir is in front of the tab $7^a$ of the first voussoir. The juxtaposition of the surfaces $2^a$ and $3^a$ with respect to each other is accompanied by a penetration of the two tabs $7^a$ in the openings $8^a$ and a reciprocal engagement of the abutment surfaces $16^a$, $17^a$ and $18^a$. Placing the tab $7^a$ in an opening $8^a$ is sufficient to ensure an abutment of the assembly in both directions of the direction D owing to the double abutment surfaces $16^a$ and $17^a$. On the other hand, a tab $7^a$ which bears an abutment by its surface $18^a$ only against the facing surface of associated opening $8^a$, the abutment will be ensured only in a single radial direction but the presence of two tabs and two openings having reverse positions also permits achieving the abutment in the second radial direction.

The voussoirs are to be bolted between adjacent walls 2 and 3 or 2A and 3A by means of bolts not shown and of holes 24 in walls 2 or 2A and slots 25 in walls 3 or 3A.

There is thus achieved an excellent positioning and centering of the voussoirs with respect to each other in both the axial direction and radial direction. Although the embodiment shown in FIG. 2 does not show it, there may also be provided projecting elements and associated hollow elements on the circumferential surfaces $4^a$ and $5^a$ of the vousoirs.

What we claim is:

1. In a casing voussoir comprising a web in the general shape of a sector of a cylindrical ring and at least a first juxtaposition wall and a second juxtaposition wall which are substantially perpendicular to said web and substantially radial relative to the axis of the cylindrical ring, guide means for the juxaposition of said first and second walls between two neighbouring voussoirs of the casing; the improvement comprising the combination of the following features, said guide means are constituted by at least two elements of conjugate shape, one being a hollow in said first wall and the other being a projection on said second wall, said elements having a clearance therebetween when the two voussoirs are juxtaposed along said walls, at least one of said elements being tapered to facilitate the introduction of the projection in the hollow when assembling said neighbouring voussoirs, and said hollow element comprises an opening in the first wall surrounded by a portion which is integral with said first wall around the opening and projects inwardly of the voussoir.

2. A voussoir as claimed in claim 1, wherein said projection has inclined guide surfaces which are convergent and said hollow has inclined guide surfaces which are divergent in planes perpendicular to the axis of said cylindrical ring.

3. A voussoir as claimed in claim 2, wherein said projection has inclined guide surfaces which are convergent and said hollow has inclined surfaces which are divergent in planes parallel to a plane which is tangent to said cylindrical ring in the region of said second wall.

4. A voussoir as claimed in claim 1 wherein the hollow element comprises an opening in the first wall which opens directly onto the side of the voussoir corresponding to the interior of the casing.

5. A voussoir as claimed in claim 3, comprising a single projecting element on said second wall and a single hollow element on said first wall, said elements having guide surfaces for locating the voussoirs both radially and axially of said cylindrical ring.

6. A voussoir as claimed in claim 1, wherein the projecting element is constituted by a boss and the hollow element by a dish portion.

7. A voussoir as claimed in claim 1, wherein the projecting element and the hollow element have the general shape of a truncated cone.

8. In a casing voussoir comprising a web in the general shape of a sector of a cylindrical ring and at least a first juxtaposition wall and a second juxtaposition wall which are substantially perpendicular to said web and substantially radial relative to the axis of the cylindrical ring, guide means for the juxtaposition of said first and second walls between two neighbouring voussoirs of the casing; the improvement comprising the combination of the following features, said guide means are constituted by at least two elements of conjugate shape, one being a hollow in said first wall and the other being a projection on said second wall, said elements having a clearance therebetween when the two voussoirs are juxtaposed along said walls, at least of said elements being tapered to facilitate the introduction of the projection in the hollow when assembling said neighbouring voussoirs, wherein said projection element and said hollow element include a planar surface which is inclined with respect to the web and parallel to said ring axis.

* * * * *